US005807185A

United States Patent [19]

Raubuck et al.

[11] Patent Number: 5,807,185

[45] Date of Patent: Sep. 15, 1998

[54] ADAPTIVE PHYSICAL EDUCATION DEVICE

[76] Inventors: Daniel Raubuck, 8600 E. Davis Rd., Terre Haute, Ind. 47805; Bruce C. Lautenschlager, 308 S. 13th St., Terre Haute, Ind. 47807

[21] Appl. No.: 625,164

[22] Filed: Apr. 1, 1996

[51] Int. Cl.[6] ..... A63B 69/36; A63B 53/00; A63B 59/00

[52] U.S. Cl. ..... 473/229; 473/457; 473/564; 473/282; 280/250.1; 280/30; 124/1; 124/8

[58] Field of Search ..... 124/4, 8, 5, 1; 273/129 V; 473/229, 457, 564, 282; 280/30, 250.1

[56] References Cited

U.S. PATENT DOCUMENTS

| | | | |
|---|---|---|---|
| 1,173,818 | 2/1916 | Lins | 273/129 X |
| 3,341,202 | 9/1967 | Stars | 273/129 X |
| 3,410,258 | 11/1968 | Lee | 124/6 |
| 3,598,413 | 8/1971 | Lippert | 273/129 |
| 4,368,898 | 1/1983 | Lay | 280/289 |
| 4,470,598 | 9/1984 | Steele et al. | 273/54 |
| 4,753,449 | 6/1988 | Doulet | 280/289 |
| 4,911,435 | 3/1990 | Johns | 272/134 |
| 4,984,802 | 1/1991 | Barraclough | 273/192 |
| 5,022,656 | 6/1991 | Tiller | 273/186 A |
| 5,363,934 | 11/1994 | Edmond et al. | 180/6.5 |

*Primary Examiner*—George J. Marlo
*Attorney, Agent, or Firm*—Thomas E. Coverstone

[57] ABSTRACT

An adaptive physical education device has a frame with a variety of attachable components so that the device may be adapted to a variety of sporting applications, such as golf, baseball, and hockey. The frame, in the preferred embodiment, attaches to the front portion of a wheelchair using a pair of adjustable wheelchair brackets. A pivotable "L" shaped post is attachable to the frame so that the pivotable post may be attached pointing upwards or downwards to accommodate different swinging motions of a bat or a club. An elastic spring is attached to the pivotable post at one end and to the club or bat at the opposite end. A handle is attached to the club or bat, so that the wheelchair participant may grasp the handle while seated in the wheelchair, pull back the handle, extending the elastic spring, and let go of the handle, the elastic spring propels the club or bat forward.

16 Claims, 6 Drawing Sheets

ADAPTIVE PHYSICAL EDUCATION DEVICE

TECHNICAL FIELD OF THE INVENTION

This invention relates to physical education devices, and more particularly, to physical education devices designed for use by handicapped or wheel chair bound participants.

BACKGROUND OF THE INVENTION

In many public supported schools, physical education is a course that is required curriculum. Therefore, in many physical education classes while the average person in participating in kickball, softball, and hockey, the handicapped people are left with an inactive role, such as score keeping, equipment manager, or the like.

Nevertheless, a variety of devices have been either specifically developed to include handicapped, wheel chair bound, or otherwise incapacitated people in a wide array of sporting activities, or the devices may be adapted to include the handicapped participant.

For example, U.S. Pat. No. 3,410,258 issued to Lee discloses a ball propelling device, which propels the ball forward by an lever actuated by the handle when the handle is displaced.

U.S. Pat. No. 3,598,413 issued to Lippert discloses a spring actuated apparatus for propelling a ball forward, wherein the device is mounted atop of a cart, the user aims the device and pulls a trigger, which actuates an arm to strike the ball.

U.S. Pat. No. 4,368,898 issued to Lay discloses a bowling ramp attachment for a wheelchair, wherein the ramp fastens to the front portion of a wheelchair and has a track for aiming and dispensing a ball, such as a bowling ball.

U.S. Pat. No. 4,470,598 issued to Steele et al. discloses a wheelchair bowling device, wherein the device attaches to the front of a wheelchair and has a spring or other propulsion means to propel the ball forward.

U.S. Pat. No. 4,753,449 issued to Doucet discloses a recreation device that attaches to a wheelchair, wherein the device is a bracket that is attached to the wheelchair frame, the bracket has a loop at the user's end so that the loop may hold a ball.

U.S. Pat. No. 4,911,435 issued to Johns discloses exercise equipment that is adaptable to users in wheelchairs.

U.S. Pat. No. 5,363,934 issued to Edmund et al. discloses a wheelchair that is intended for use on the golf course, wherein the seat can be automatically raised so to allow the user to stand and swing a conventional golf club.

Nevertheless, the above mentioned patents have limited use in a physical education environment, especially with severely handicapped students.

Therefore, what is needed is an adaptive physical education device, wherein the device allows a student in a physical education environment to participate in class exercises and even team sports.

DISCLOSURE OF THE INVENTION

It is, therefore, an object of the present invention to provide an adaptive physical education device that allows handicapped people and wheelchair bound people to participate in sporting events.

It is also an object of the present invention to provide an adaptive physical education device that allows handicapped and wheelchair people to participate in team sports, such as baseball and hockey.

It is also an object of the present invention to provide a lightweight adaptive physical education device that may be attached to the front of a wheelchair or may be located directly in front of a wheelchair so that the handicapped person can stand directly in front of the wheelchair and activate the device.

It is also an object of the present invention to provide an adaptive physical education device that may be attached to the front of a wheelchair and wherein the device may be adjusted vertically and horizontally so that the device may accommodate a variety of wheelchair and participant sizes, and wherein said adjustment provides the user with a variety of swing choices, such as in the case of a baseball swing, a grounder or a pop fly.

It is also an object of the present invention to provide an adaptive physical education device that is relatively inexpensive to manufacture and assemble.

According to the present invention, an adaptive physical education device has a frame with a variety of attachable components so that the device may be adapted to a variety of sporting applications, such as golf, baseball, and hockey. The frame, in the preferred embodiment, attaches to the front portion of a wheelchair using a pair of adjustable wheelchair brackets. The frame has a pair of extensions that may be slidably connected to the adjustable wheelchair brackets. The frame has a coupling that allows the mounting of a pivotable golf club. The club is vertically adjustable in relation to the frame; the frame is also vertically and horizontally adjustable via the adjustable wheelchair brackets. An elastic spring means is attached to a pivotable post at one end and to the club at the opposite end. A handle is attached to the club, so that the wheelchair participant may grasp the handle while seated in the wheelchair, pull back the handle, extending the elastic spring means, and let go of the handle, the elastic spring means propels the club forward. The club strikes a ball located underneath the frame. The device is easily adapted to accommodate a left or right handed hitter by switching the bat and the ball holder to the opposite vertical posts.

With a few modifications, the golf club may be removed while a baseball bat is mounted to the device. The club is removed from the frame and a horizontally pivotable plastic bat is attached to the frame at a first vertical post. A ball holder is positioned at a second vertical post. The elastic spring means is disconnected from the club and attached to the bat. The bat has a handle, so that the wheelchair participant may pull back on the handle extending the elastic spring means, let go the handle, which in turn propels the bat forward, hitting a ball resting in the ball holder.

In a separate embodiment, the components remain the same as the described embodiments, except that a pair of stabilizers are attached to the frame so that the device may be adapted for use with handicapped participants who have the capability to stand up from their wheelchairs. The device may be positioned directly in front of the wheelchair so that the participant may stand up from the wheelchair, strike the ball, then immediately sit back down in the wheelchair.

The device of the present invention allows handicapped and wheelchair bound people to participate in a variety of sporting activities. The device may be adapted with a variety of bats, clubs, or rackets and is not limited to golf, baseball, or hockey. For example, the device could be adapted to swing a tennis racket instead of bat. The first version of use described above with the club describes a vertical swinging motion, which would also be compatible with croquet, cricket, bowling and the like. The second version of use described above with the bat describes a horizontal swinging motion, which would be compatible with tennis or racquetball.

The foregoing and other advantages of the present invention will become more apparent from the following description and accompanying drawings.

BEST MODE FOR CARRYING OUT THE INVENTION

Figure 1:
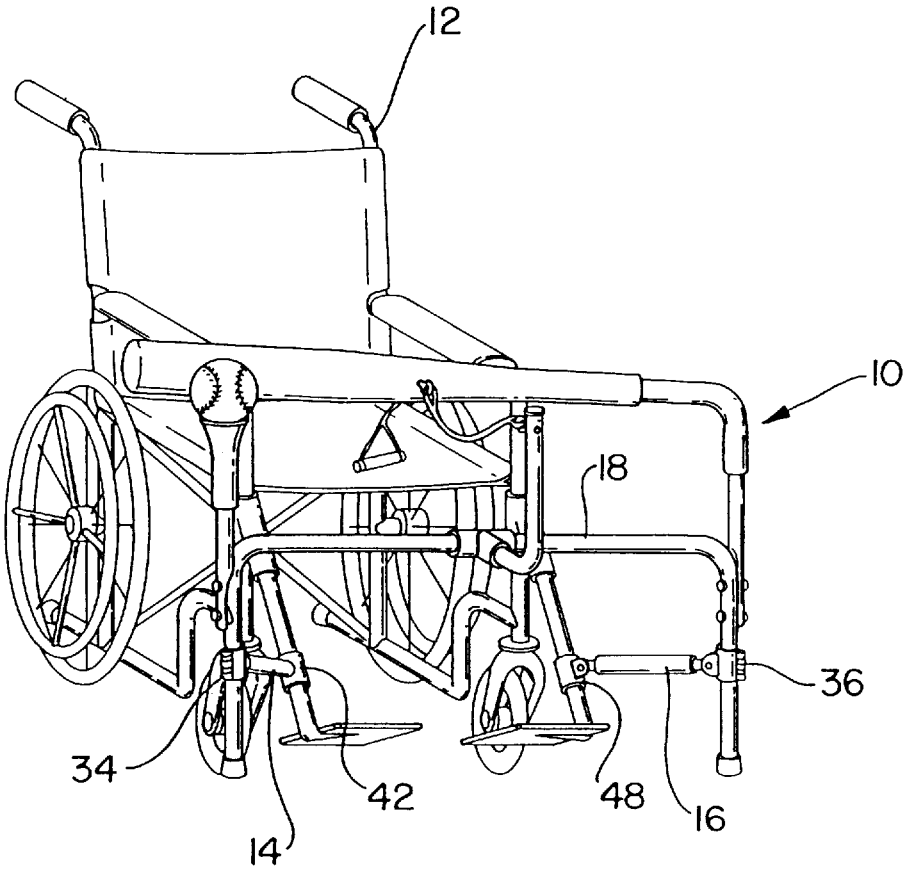
FIG. 1 is a front perspective view of an adaptive physical education device of the present invention shown attached to a wheelchair.

According to the present invention, and as shown in FIG. 1, an adaptive physical education device 10 is disclosed that may be attached to the front of a wheelchair 12. The device 10 is intended to allow handicapped and wheelchair bound people to participate in physical education activities, such as baseball, golf and hockey, to name a few.

Figure 2:
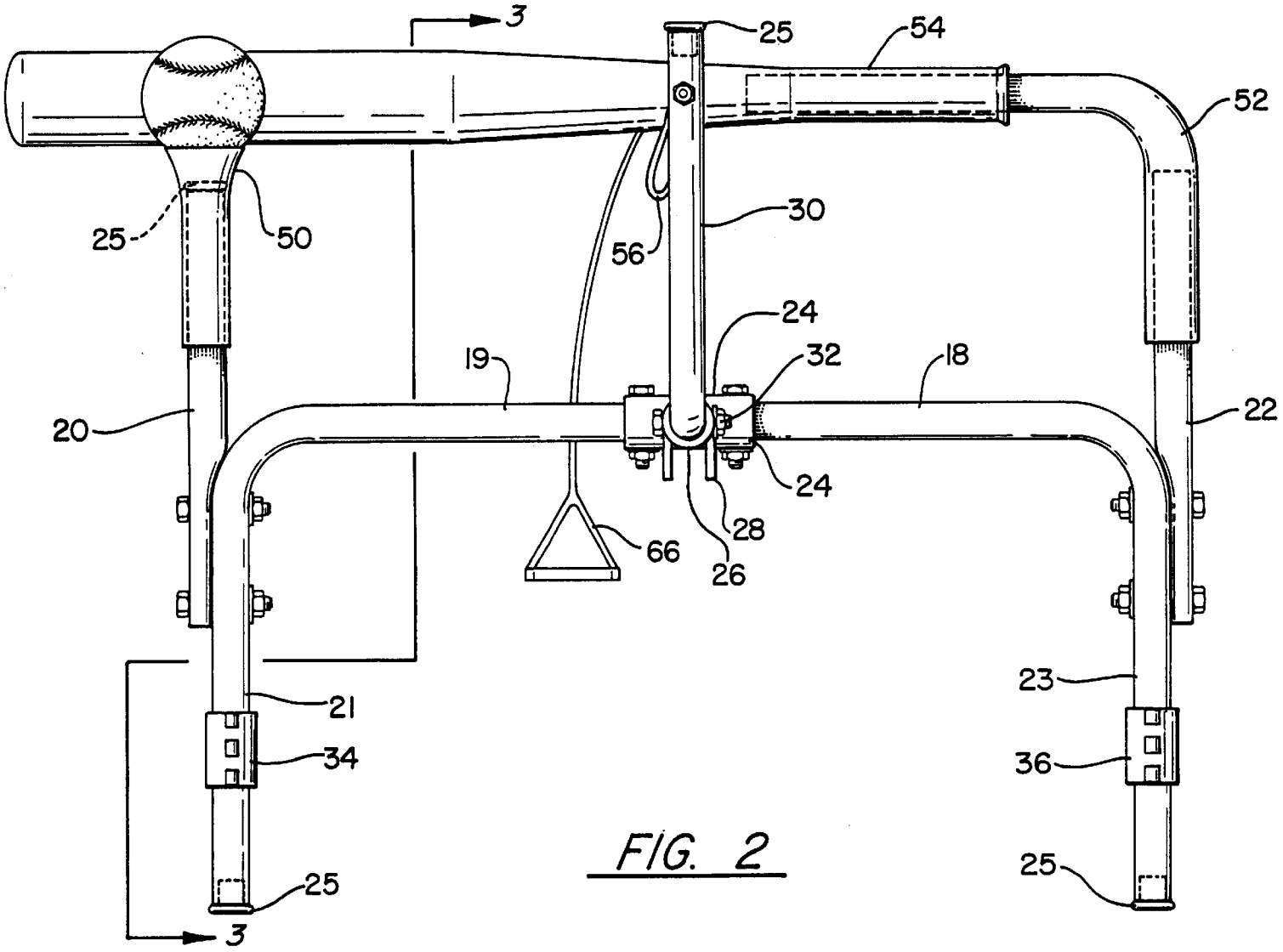
FIG. 2 is a front elevational view of the adaptive physical education device of the present invention with a bat attached to the device.

A first extension 14 and a second extension 16 extend from a device frame 18 to attach the device 10 to the wheelchair 12. As shown in FIG. 2, the frame 18 is essentially "U" shaped and is intended to straddle the wheelchair anterior side. The frame 18 has a first lateral side 21, an opposite second lateral side 23, with both lateral sides 21 and 23 connected by a midsection 19. Extending vertically from the first lateral side 21 is a first vertical post 20 and an opposite second vertical post 22 extends vertically from the second lateral side 23. Frame caps 25 are placed in the open ends of the frame 18.

Figure 3:
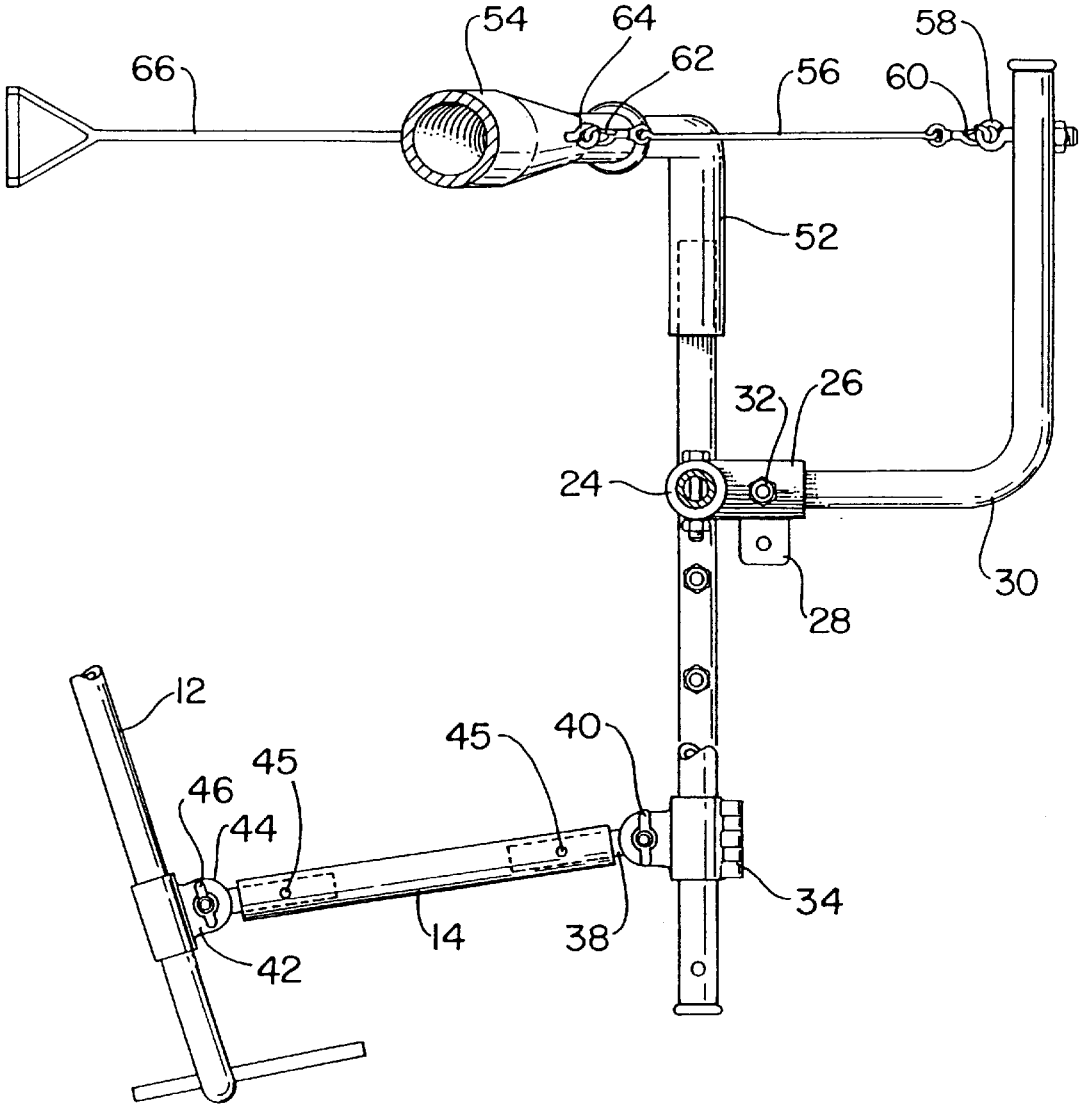
FIG. 3 is a side cross sectional view of the adaptive control device of the present invention taken along line 3—3 from FIG. 2, shown attached to the wheelchair.

At the midsection 19 is a coupling 24. As shown in FIG. 3, extending forward from the coupling 24 is a coupling extension 26 with a hollow bore. Approximately 90 degrees from the coupling extension 26 is a coupling bracket 28, which extends downward. A pivotable post 30 is adapted to be placed in the coupling extension 26, and more specifically, the coupling bore. The pivotable post 30 is pinned in place with a pivotable post pin 32, which is placed through the coupling extension 26 and the pivotable post 30.

As shown in FIG. 3, the frame 18 has a first hinged frame bracket 34 that attaches to the first lateral side 21. An opposite second hinged frame bracket 36 attaches to the frame at the second lateral side 23. A winged nut and bolt arrangement 40 pivotally connects a first frame bracket stud 38 to the first frame bracket 34.

A first hinged wheelchair bracket 42 fastens to the wheelchair frame and is fastened together by a winged nut and bolt arrangement 46. The hinged brackets are designed to wrap around the framework of the wheelchair and the device and then clamp to the framework with the tightening of a nut and bolt. A wheelchair stud 44 pivotally fastens to the wheelchair bracket 42. The wheelchair stud 44 and the frame stud 38 each may be independently adjusted by loosening the nut and bolt arrangement 46 or 40. The first extension 14 slidably attaches to the wheelchair stud 44 and the frame stud 38, as shown in FIG. 3. Locking pins 45 lock the extensions 14 and 16 to the wheelchair studs and the frame studs.

As shown in FIG. 1, a second hinged wheelchair bracket 48 attaches to the second hinged frame bracket 36, with the second extension 16 slidably attaching to another wheelchair stud and frame stud at the second lateral side 23.

Now referring back to FIG. 2, the device 10 is shown outfitted with a bat and a ball. A ball holder 50 slides over the first vertical post 20. A pivotable bat arm 52 slides over the second vertical post 22. A plastic bat 54 is positioned at the terminal end of the pivotable bat arm 52. The arm 52 extends internally through the bat 54 so that the bat 54 is rigid with the arm 52.

As shown in FIG. 3, the bat 54 is attached to the pivotable post 30 by an elastic band 56. The elastic band 56 has a first releasable snap 60 at one end and a second releasable snap 62 at a second end. The first releasable snap 60 attaches to a pivotable post eye bolt 58, which is secured through the pivotable post 30. The second releasable snap 62 attaches to a bat eye bolt 64, which is secured through the bat 54. A handle 66 is also attached to the bat 54.

The wheelchair bound participant would draw the bat 54 backward toward the wheelchair by pulling on the handle 66, which in turn, would apply pressure to the elastic band 56. At the desired point, the participant would let go of the handle 66, the elastic band 56 would pull the bat 54 toward the ball holder 50, which in turn would cause the bat 54 to hit the ball. The frame 18 may be adjusted upward or downward by adjusting the wheelchair pivotable brackets 42 and 48, or by adjusting the frame pivotable brackets 34 and 36. The adjustable feature allows the participant to determine if the hit ball would be a grounder or a pop fly, for example. Of course, the participant could point the wheelchair toward first base, second base, or third base, and as the chair pointed, the frame will follow. So the participant has control of the height and the direction of the ball being hit.

Figure 4:
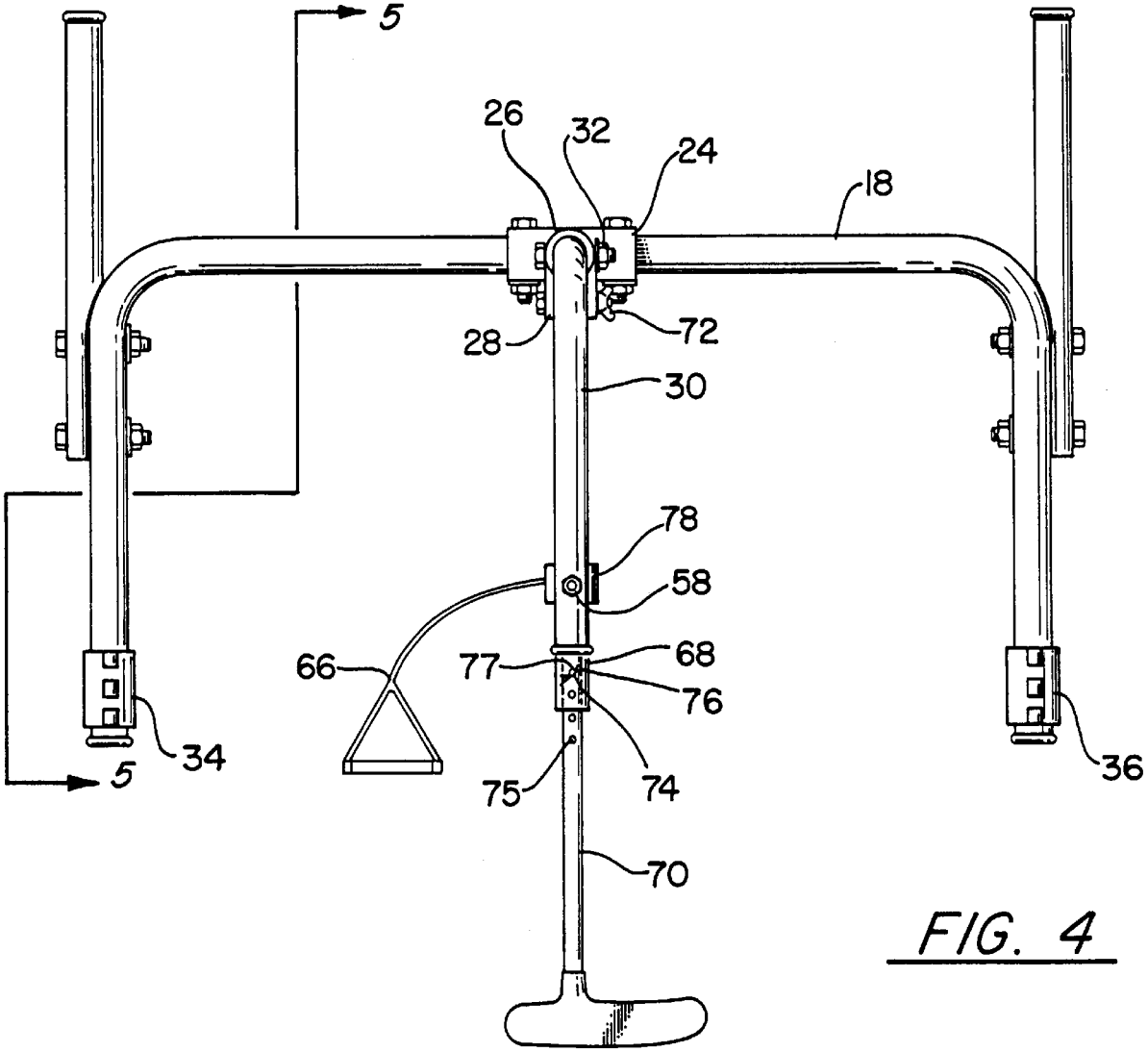
FIG. 4 is a front elevational view of the adaptive physical education device of the present invention with a club attached to the device.
Figure 5:
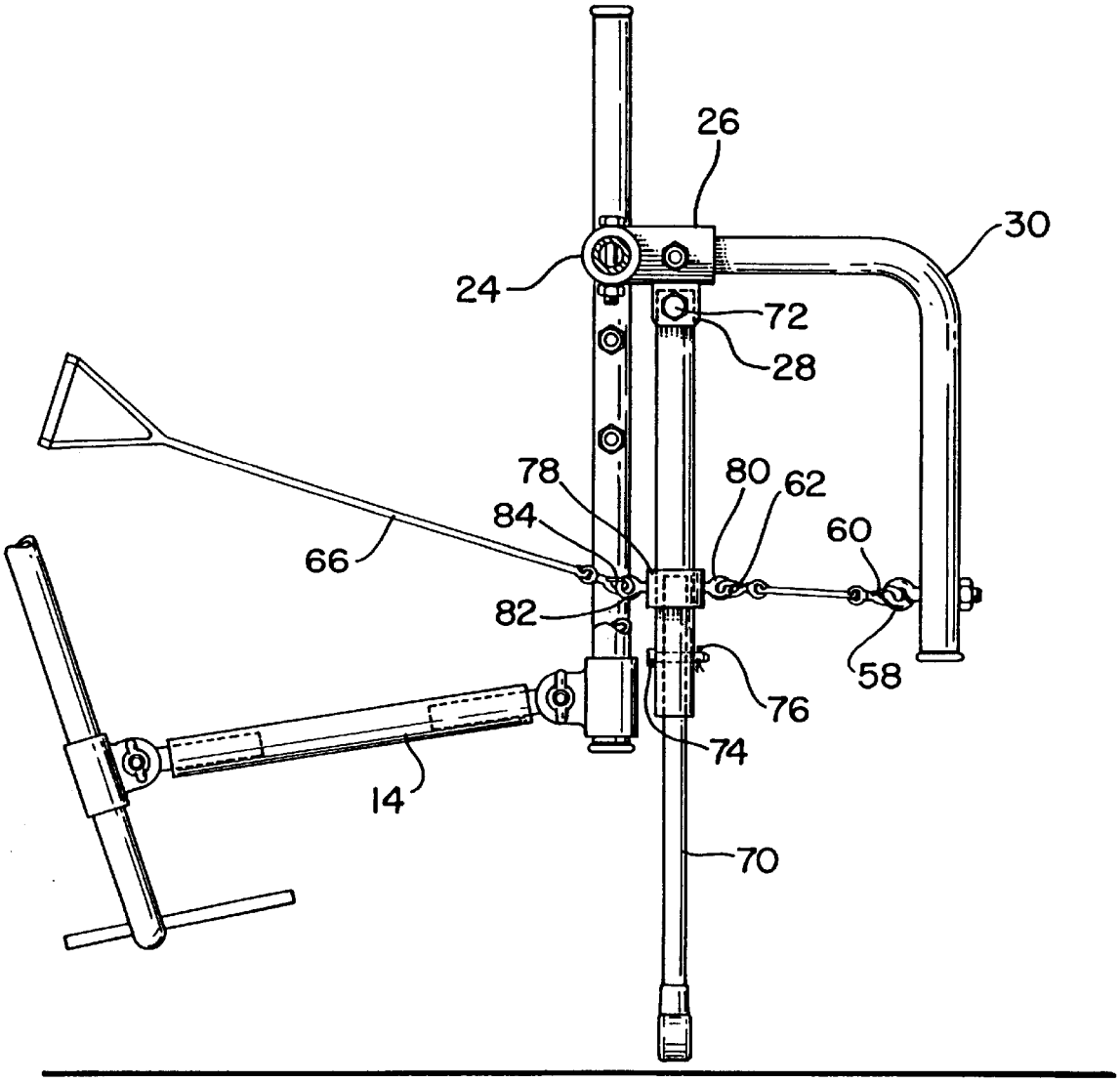
FIG. 5 is a side cross sectional view of the adaptive control device of the present invention taken along line 5—5 from FIG. 4, shown attached to the wheelchair.

As shown in FIG. 4 and in FIG. 5, the bat may be removed and the device and may be adapted to fit a club. The pivotable post pin 32 is removed and the pivotable post 30 is rotated 180 degrees, so that the post 30 points downward toward the ground. The pivotable post pin 32 is then replaced to lock the post 30 in place. The club has a top portion 68 and a bottom portion 70. The top portion 68 is positioned in the coupling bracket 28. The top club portion 68 is pivotally connected to the coupling bracket 28 with a bolt and nut arrangement 72.

The height of the club may be adjusted by a club pin 74, which is placed through the top and bottom club portions 68 and 70. A plurality of bottom club portion openings are aligned along the length of the bottom portion 70. The top portion 68 has one opening 77; the club top and bottom portions are aligned to the proper club height, the club pin 74 is then placed through the top portion opening 77 and one of the bottom portion openings 75. The club pin 74 is then pinned in place with a cotter pin 76.

A club bracket 78 is positioned around the top club portion 68. The club bracket 78 has a first eye bolt 80 and a second eye bolt 82. The elastic band 56 is fastened to the club top portion 68 using releasable snaps 60 and 62. The handle 66 has also has a releasable snap 84, which is connected to the club bracket second eye bolt 82.

The wheelchair bound participant would draw the club 70 backward toward the wheelchair by pulling on the handle 66, which in turn, would apply pressure to the elastic band 56. At the desired point, the participant would let go of the handle 66, the elastic band 56 would pull the club 70 toward a golf ball, which in turn would cause the club 70 to hit the ball. The frame 18 may be adjusted upward or downward by adjusting the wheelchair pivotable brackets 42 and 48, or by adjusting the frame pivotable brackets 34 and 36. The adjustable feature allows the participant to determine how the club will hit the golf ball.

The club 70 may easily be replaced with a hockey stick, and the ball could easily be replaced with a puck, therefore the device 10 is not limited to golf and baseball. The two stroke or swing motions that the device 10 provides and that are described above, are the two basic swings required in sports: a horizontal swing, as used with baseball, tennis, and racquetball, and a vertical swing, as used with golf, hockey, cricket, and croquet to name a few. The device 10 of the present invention could be adapted with a wide variety of rackets or clubs. A successful prototype has been manufactured using a golf club and a baseball bat, as disclosed and described above.

Figure 6:
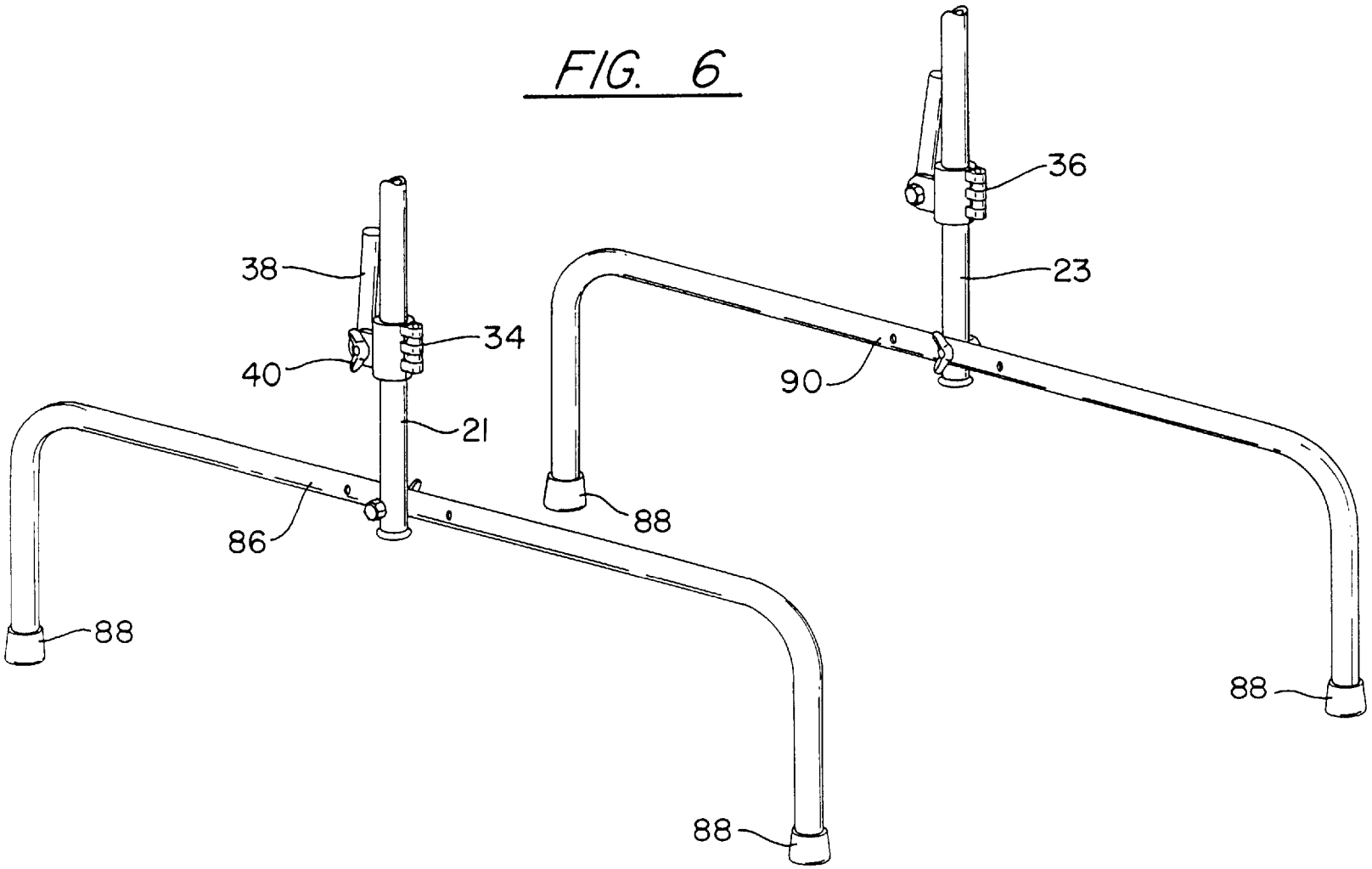
FIG. 6 is a front perspective view of the adaptive control device of the present invention, wherein the device is detached from the wheelchair and a pair of stabilizers are attached to the device.

As shown in FIG. 6, if the handicapped or wheelchair participant has the capability to stand out of the wheelchair, the device 10 may be easily modified to be detached from and independent of the wheelchair. For example, the extensions 14 and 16 would be disconnected from the wheelchair and the frame 18. The frame bracket studs 38 are then folded against the lateral sides 21 and 23. A first stabilizer 86 is attached to the first lateral side 21 and a second stabilizer 90 is attached to the second lateral side 23. Weights may be added to the stabilizers if needed. Rubber stops 88 are located on the stabilizers 86 and 90 to prevent the device 10 from sliding against the ground.

The stabilizers 86 and 90 allow the participant to stand, hit a ball, and then sit directly back into the wheelchair.

Although this invention has been shown and described with respect to a detailed embodiment, those skilled in the art will understand that various changes in form and detail may be made without departing from the spirit and scope of the claimed invention.

We claim:

1. A device to allow a wheelchair participant to hit a ball, wherein the device is attachable to a wheelchair, comprising:

a frame;

a pivotable post being pivotable and lockable in a position in relation to said frame;

a ball striking member pivotally attachable to said device;

an elongated elastic band attached to said pivotable post at a first end and attached to said ball striking member at a second end;

a handle connected to said ball striking member;

so that as the user pulls back on the handle, the ball striking member is drawn toward the user, longitudinally stretching the elastic band so that when the user lets go of the handle, the ball striking member makes a swinging motion.

2. The device of claim 1, wherein said device further comprises:

said frame having a vertical portion; and a ball holder attachable to said vertical portion.

3. The device of claim 2, wherein said device further comprises a means to attach said device to said wheelchair.

4. The device of claim 3, wherein said means to attach said device to said wheelchair further comprises:

a pair of adjustable wheelchair brackets.

5. The device of claim 1, wherein said device further comprises:

a pivotable post pin being releasably connected through a coupling and said pivotable post to lock said pivotable post.

6. The device of claim 1, wherein said device further comprises a means to attach said device to said wheelchair.

7. The device of claim 1, wherein said frame has a coupling bracket extending downward, said ball striking member being pivotally connected to said coupling bracket.

8. The device of claim 7, wherein said ball striking member has a top portion and a bottom portion;

said top portion being pivotally connected to said coupling bracket;

said bottom portion being slideably connected to said top portion, said top portion having an opening, and said bottom portion having a plurality of openings;

a pin being positioned in said top portion opening and in one of said bottom portion openings, so that the length of said bottom portion is adjustable and releasably locked with said top portion.

9. The device of claim 1, wherein said frame further comprises:

a first lateral side and an opposite second lateral side;

a first stabilizer attachable to said first lateral side; and a second stabilizer attachable to said second lateral side, each said stabilizer having at least one rubber stop adapted to be positioned against the ground or the floor.

10. A device attachable to a wheelchair, comprising:

a frame;

a pivotable "L" shaped post, said post being pivotable and lockable in relation to said frame;

a ball striking member attachable to said frame;

an elongated elastic band attached to said pivotable post at a first end and attached to said ball striking member at a second end;

a handle connected to said ball striking member;

so that as the user pulls back on the handle, the ball striking member is drawn toward the user, longitudinally stretching the elastic band so that when the user lets go of the handle, the ball striking member makes a swinging motion.

11. The device of claim 10, wherein said pivotable "L" shaped post is pivotable and lockable in a first position pointing relatively upwards and a second position pointing relatively downwards;

so that when the pivotable "L" shaped post is in the first position, the ball striking member swings approximately parallel to the ground and when in the second position, the ball striking member swings approximately perpendicular to the ground.

12. The device of claim 10, wherein said ball striking member is a golf club.

13. The device of claim 10, wherein said ball striking member is a baseball bat.

14. The device of claim 10, wherein said device further comprises:

said frame having a vertical portion; and a ball holder attachable to said vertical portion.

15. The device of claim 10, wherein said device further comprises:

a fastening means to attach the device to the existing wheelchair.

16. The device of claim 10, wherein said frame further comprises:

a bracket extending downward, said ball striking member being pivotally connected to said bracket.

* * * * *